US006502434B1

(12) United States Patent
Doelle

(10) Patent No.: US 6,502,434 B1
(45) **Date of Patent: *Jan. 7, 2003**

(54) EFFLUENT SHOWER FOR PULP WASHER

(75) Inventor: Klaus Doelle, Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 30 days.

This patent is subject to a terminal disclaimer.

(21) Appl. No.: 09/688,530

(22) Filed: Oct. 16, 2000

Related U.S. Application Data

(62) Division of application No. 09/216,185, filed on Dec. 18, 1998, now Pat. No. 6,151,931.

(51) Int. Cl.[7] ..... D21C 1/02

(52) U.S. Cl. ..... 68/205 R; 134/122 R; 134/129; 134/131; 134/183; 162/60; 162/272; 162/275; 118/324; 239/587.1; 239/587.5; 239/DIG. 12; 210/409

(58) Field of Search ..... 68/205 R; 134/122 R, 134/129, 131, 183; 162/60, 272, 275; 118/324; 239/587.1, 587.5, DIG. 12; 210/409

(56) References Cited

U.S. PATENT DOCUMENTS

| | | | | |
|---|---|---|---|---|
| 3,526,017 | A | 9/1970 | Kleimola | 162/272 X |
| 4,141,789 | A | 2/1979 | Justus | 162/272 |
| 4,670,099 | A | 6/1987 | LaValley | 68/205 R |
| 4,790,155 | A | 12/1988 | Daniel et al. | 68/205 R |
| 5,494,529 | A | 2/1996 | Ciccarelli et al. | 239/587.5 X |
| 6,053,986 | A | 4/2000 | Oechsle et al. | 134/122 R |

FOREIGN PATENT DOCUMENTS

| | | |
|---|---|---|
| FR | 1168771 | 9/1958 |

*Primary Examiner*—Peter Chin
*Assistant Examiner*—Mark Halpern
(74) *Attorney, Agent, or Firm*—Taylor & Aust, P.C.

(57) ABSTRACT

A washer for washing a fiber suspension includes a porous surface traveling in a running direction and having a width in a direction transverse to the running direction. The porous surface is configured for carrying the fiber suspension thereon. A shower includes a pipe extending parallel to the width of the porous surface. The pipe has a sidewall with a longitudinally extending slot therein. The shower further includes a pair of lips connected to the pipe. The lips are positioned immediately adjacent to and on opposite sides of the slot, thereby defining a slot nozzle with a discharge gap. The lips are movable toward and away from each other to adjust the size of the discharge gap.

5 Claims, 4 Drawing Sheets

EFFLUENT SHOWER FOR PULP WASHER

This is a divisional of application Ser. No. 09/216,185, filed Dec. 18, 1998, now U.S. Pat. No. 6,151,931.

BACKGROUND OF THE INVENTION

1. Field of the Invention

The present invention relates to a pulp washer for washing effluents from a fiber suspension, and, more particularly, to a shower for such a washer.

2. Description of the Related Art

A pulp washer is used to wash effluents from a fiber suspension used in a paper-making machine to make a fiber web such as paper. A fiber suspension with a predetermined basis weight is transported into the washer where effluents in the fiber suspension are typically separated from the fiber suspension through drainage via gravitational force and centrifugal forces. The fiber suspension is normally carried by a wire through the washer. One or more showers which extend across the width of the wire in a direction transverse to the running direction are used to jet a fluid against the fiber suspension which is used to dilute and wash the fiber suspension.

A shower as described above typically includes a pipe with a plurality of holes formed therein through which the cleaning liquid flows. The cleaning liquid is ejected directly from each hole and impinges upon the fiber suspension. Thus, a typical shower ejects a large number of relatively small diameter or fan shaped streams of liquid against the fiber suspension. Separate and discrete streams of jetted liquid may result in mixing and displacement of the fibers within the fiber suspension to an undesirable degree.

Additionally, with a shower as described above, the impingement angle of each jet of cleaning liquid relative to the fiber suspension is predetermined and fixed. However, for different applications and types of fiber suspension, it may be desirable to change the impingement angle between the jets of liquid and the fiber suspension.

What is needed in the art is an effluent shower for a pulp washer which is cheaper and easier to construct, provides a uniform and variable jet which impinges upon the fiber suspension, and allows the jet to impinge upon the fiber suspension at an adjustable angle.

SUMMARY OF THE INVENTION

The present invention provides a washer for a fiber suspension with a shower constructed from a pipe with a longitudinally extending slot. A pair of lips are connected to the pipe on opposite sides of the slot and are movable toward and away from each other to adjust a size of the discharge gap defined therebetween.

The invention comprises, in one form thereof, a washer for washing a fiber suspension. The washer includes a porous surface traveling in a running direction and having a width in a direction transverse to the running direction. The porous surface is configured for carrying the fiber suspension thereon. A shower includes a pipe extending parallel to the width of the porous surface. The pipe has a sidewall with a longitudinally extending slot therein. The shower further includes a pair of lips connected to the pipe. The lips are positioned immediately adjacent to and on opposite sides of the slot, thereby defining a slot nozzle with a discharge gap. The lips are movable toward and away from each other to adjust the size of the discharge gap. The pipe may also include a plurality of aligned discharge openings rather than the slot.

An advantage of the present invention is that the basic construction component of the shower is a pipe, thereby making the shower simple and easy to build.

Another advantage is that the slot nozzle is adjustable to define an adjustable discharge gap.

Yet another advantage is that the lips of the slot nozzle may be contoured to provide desired fluid dynamics for a specific application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
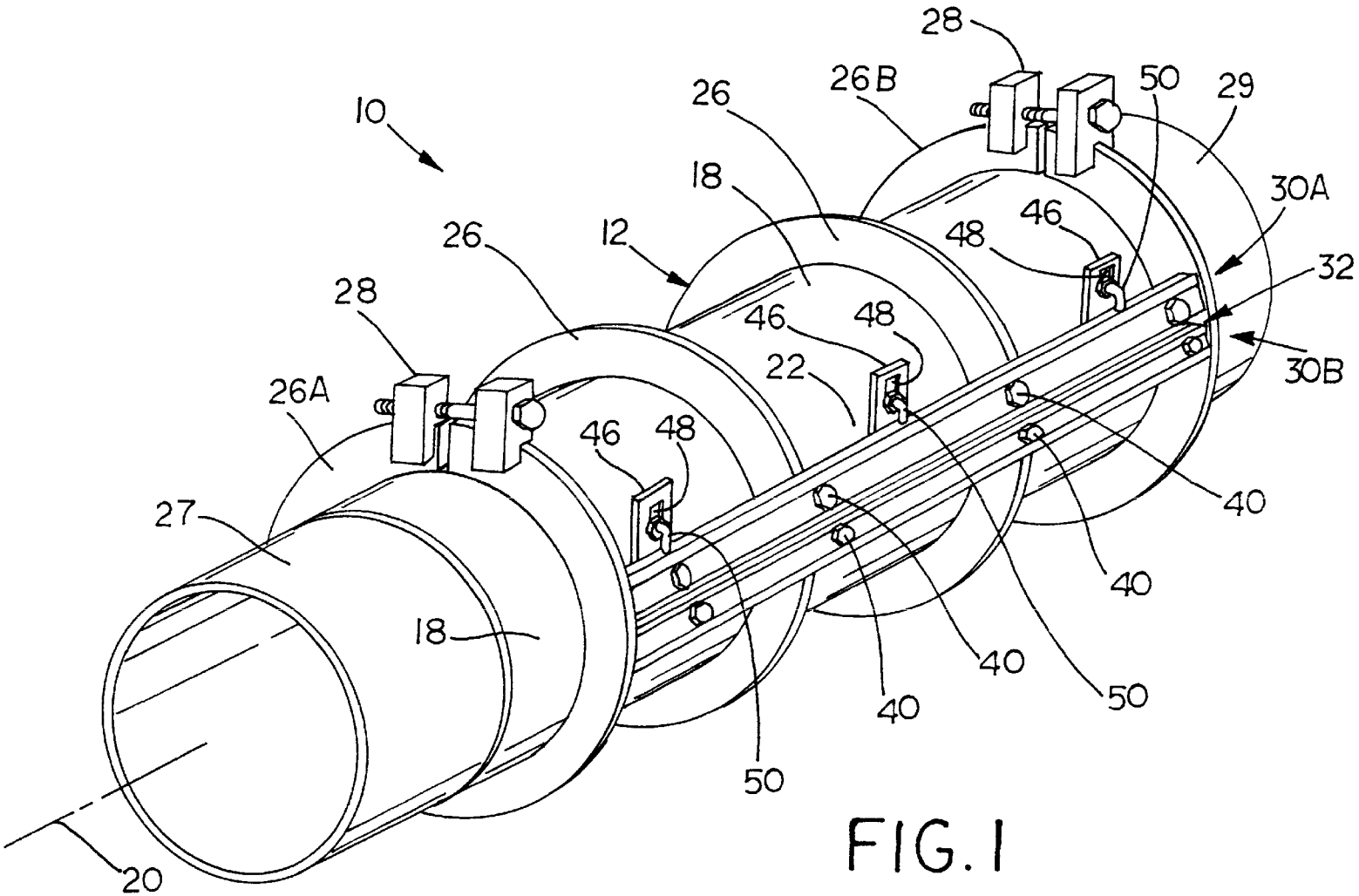
FIG. 1 is a perspective view of an embodiment of an effluent shower of the present invention used in a pulp washer.
Figure 2:
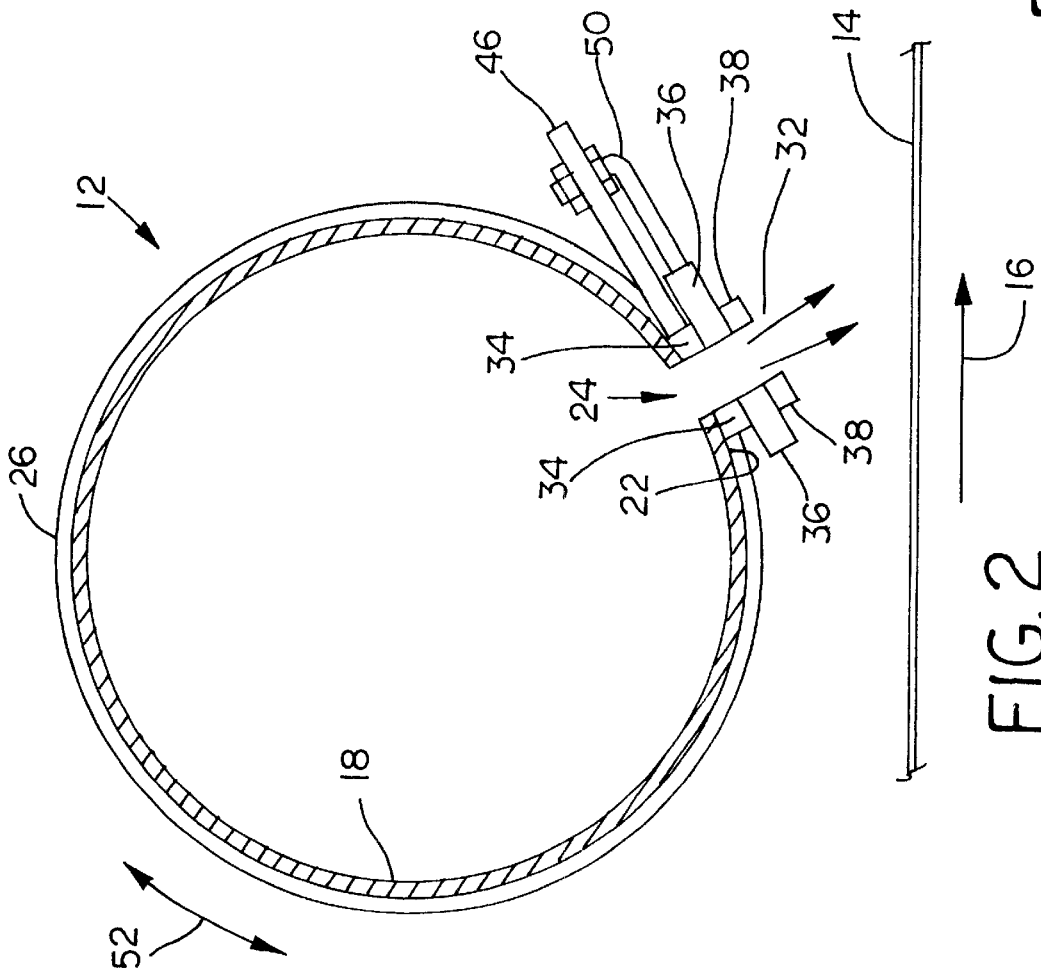
FIG. 2 is a side sectional view taken along line 2—2 in FIG. 1.

Referring now to the drawings, and more particularly to FIGS. 1 and 2, there is shown a pulp washer 10 including an embodiment of an effluent shower 12 for washing effluents from a fiber suspension carried on a porous surface 14. Washer 10 forms part of a fiber stock preparation system which is used to prepare a stock slurry in the form of a fiber suspension used to feed a paper-making machine (not shown).

Porous surface 14, which in the embodiment shown is in the form of a forming fabric or wire of known construction, travels in a running direction 16 and has a width in a direction transverse to running direction 16 (i.e., perpendicular to the drawing of FIG. 2). Wire 14 is configured for carrying a thin layer of a pulp suspension, such as a fiber pulp suspension, thereon for transporting the fiber suspension through washer 10. Wire 14 is carried within washer 10 by a plurality of rolls (not shown), and may also be in contact with a plurality of blades, foils, etc. The effluent is separated from the fiber suspension within washer 10 using pressure and/or centrifugal force.

Shower 12 includes a pipe 18 which extends parallel to the width of wire 14. Pipe 18 is substantially cylindrical in the embodiment shown and defines a longitudinal axis 20. Pipe 18 may have any other suitable cross-sectional configuration, such as conical, elliptical, etc. Pipe 18 includes a side wall 22 with a longitudinally extending slot 24 therein. Slot 24 extends substantially the width of wire 14 in a direction transverse to running direction 16, such that substantially all of the fiber suspension carried on wire 14 is washed using shower 12. A plurality of annular gussets 26 are spaced along the length of pipe 18 and partially surround pipe 18, except for structure associated with slot 24. Gussets 26 inhibit radial expansion of pipe 18 during use and may have any suitable configuration. In the embodiment shown, each gusset 26 is an annular plate which partially surrounds and is welded to pipe 18. A pair of gussets 26A and 26B at opposing ends of pipe 18 include respective clamps 28 which allow pipe 18 to be slightly contracted in a radial direction so that pipe 18 may be respectively connected at each end thereof with an inlet pipe 27 for transporting liquid to pipe 18 and a cap 29 for capping an opposite end of pipe 18.

Figure 3:
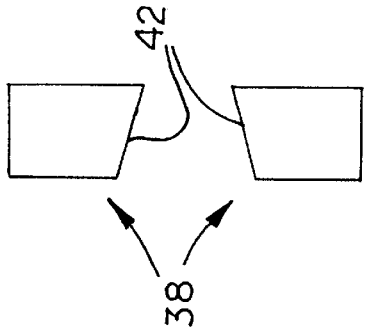
FIG. 3 is a side view of the pair of lips used on the washer of FIG. 1.
Figure 4:
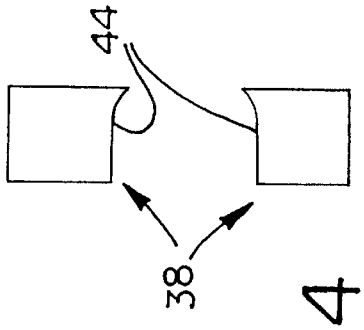
FIG. 4 is another embodiment of a pair of lips which can be used with the washer of the present invention.

A pair of lips 30A and 30B are each connected to pipe 18 at positions which are immediately adjacent to and on opposite sides of slot 24. Each lip 30A and 30B is connected to pipe 18 and constructed such that lips 30A and 30B are movable toward and away from each other to adjust the size of a discharge gap 32 defined therebetween. More particularly, top lip 30A includes a fixed rectangular portion 34 which is rigidly connected with pipe 18 immediately adjacent to slot 24, such as through welding, bolts, or the like. An intermediate slidable bar 36 is disposed immediately adjacent to rectangular portion 34, and is slidably connected with rectangular portion 34 using, e.g., sealed keyways, tongue and groove arrangements, etc. An outer lip 38 is rigidly attached to slidable bar 36 using a plurality of fasteners such as bolts 40. Outer lip 38 includes an inside surface 42 adjacent to discharge gap 32 which is contoured for a specific application. In the embodiment shown in FIGS. 1 and 2, each outer lip 38, shown more particularly in FIG. 3, has a substantially planar inside surface which is disposed at a relatively small acute angle so that discharge gap 32 is in effect constructed as a tapered nozzle. Each outer lip 38 may be constructed with a different contour, such as the curved, concave inside surface 44 shown in FIG. 4.

Bottom lip 30B is constructed similar to top lip 30A, and likewise includes a fixed rectangular portion 34, bar 36 and outer lip 38. However, bar 36 is not slidably movable relative to fixed rectangular portion 34. Rather, bar 36 is rigidly affixed to rectangular portion 34.

The plurality of brackets 46 are connected with top rectangular portion 34, and thus are indirectly connected with pipe 18. Brackets 46 are spaced apart along the length of pipe 18, and are substantially immovable relative to pipe 18. Each bracket 46 includes an elongate opening 48 extending and having a major axis which is transverse to slot 24 and discharge gap 32. A plurality of fasteners 50, which are in the form of L-shaped threaded bolts in the embodiment shown, include one end thereof which is rigidly attached with slidable bar 36, and an opposing end thereof which is received within a corresponding elongate opening 48 of a bracket 46. By adjusting the position of a corresponding fastener 50 within an elongate opening 48, top lip 30A may be locally deflected toward or away from discharge gap 32 to locally adjust the size of discharge gap 32.

During use, a liquid such as clean water is transported into pipe 18 at a known pressure. The pressurized fluid flows through slot 24 and is ejected from discharge gap 32 defined between lips 30A and 30B onto the fiber suspension carried by wire 14. The impingement angle between the liquid which is jetted from shower 10 and wire 14 may be adjusted by rotating shower 12 in a selected rotational direction 52 and tightening a clamp 28 around inlet pipe 27. Moreover, the flow velocity of the liquid which is jetted from shower 12 may be matched to the traveling speed of wire 14 in running direction 16 so that mixing or displacement of the fiber suspension does not occur to an undesirable extent.

Figure 5:
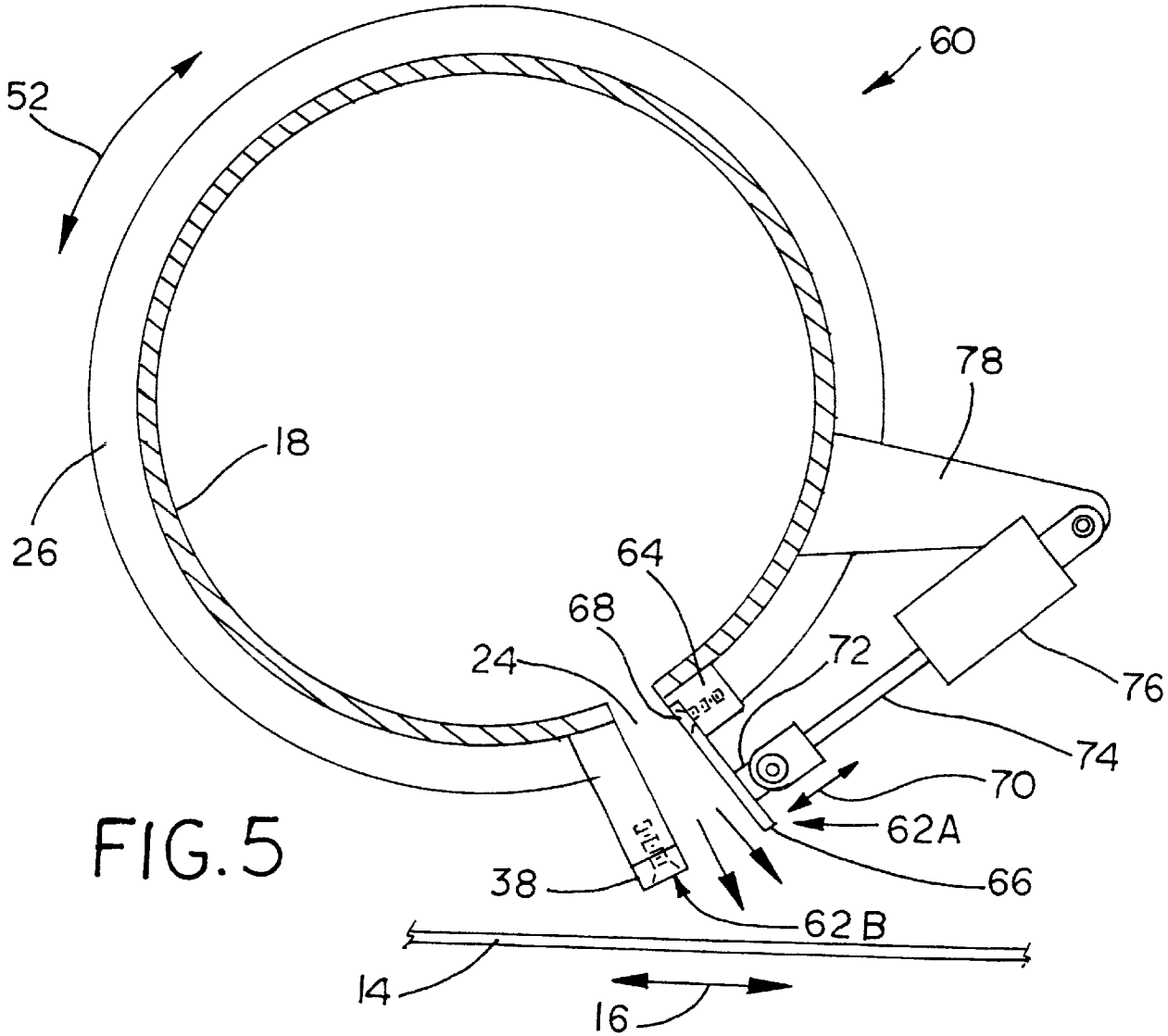
FIG. 5 is a side sectional view of another embodiment of an effluent shower of the present invention.

Referring now to FIG. 5, another embodiment of an effluent shower 60 of the present invention is shown. Shower 60 is used to spray a liquid at a desired impingement angle and flow velocity against a fiber suspension carried by a wire 14 and moving in a running direction 16, similar to the embodiment of shower 12 shown in FIGS. 1 and 2. Shower 60 also includes a pipe 18 and a plurality of gussets 26, similar to the embodiment of shower 12. Additionally, shower 60 is rotatable about a longitudinal axis of pipe 18 to adjust an impingement angle of the liquid jetted therefrom, relative to wire 14, as indicated by rotational arrow 52. Shower 60 differs from shower 12 in that shower 60 is configured so that at least one of lips 62A and 62B is automatically adjustable toward and away from the other lip 62A or 62B to provide automatic adjustment of discharge gap 32.

More particularly, lip 62A includes a fixed rectangular portion 64 which is rigidly affixed with pipe 18, such as by welding. Rectangular portion 64 extends substantially across the width of slot 24. A bendable plate 66 is rigidly affixed along one edge thereof with rectangular portion 64 so that the affixed edge is substantially immovable relative to pipe 18. In the embodiment shown, plate 66 is fastened to rectangular portion 64 using a plurality of fasteners such as bolts 68 which are spaced apart along the length of plate 66. Plate 66 is constructed from a material having a modulus of elasticity which is sufficient to allow plastic deformation of plate 66 to an extent corresponding to a desired adjustment amount of discharge gap 32. For example, plate 66 may be constructed from a suitable metallic or plastic material with a modulus of elasticity allowing plate 66 to be bent toward and away from plate 62B, as indicated by double headed arrow 70.

To effect automatic and local adjustment of plate 66 across the length thereof, a plurality of linear actuators in the form of pneumatic cylinders are spaced apart along the length of and connected with plate 66. More particularly, a plurality of standoffs 72 which are rigidly attached to and spaced apart along the length of plate 66 are pivotally connected to one end of a piston 74 of a corresponding pneumatic cylinder 76. Pneumatic cylinder 76 is pivotally connected at the other end thereof with a respective bracket 78 which is rigidly attached to and extends from pipe 18. Actuation of a pneumatic cylinder 76 causes piston 74 to move in a selected direction 70 toward or away from lip 62B, thereby in turn causing local plastic deformation and adjustment of plate 66. By separately controlling each pneumatic cylinder 76 along the length of plate 66, local adjustment of discharge gap 32 is accomplished.

Lip 62B is constructed to be substantially non-deflectable in the embodiment shown. An outer lip 38 is removably attached to lip 62B and has an inside surface with a selected profile, such as the straight inside surface 42 or curved inside surface 44 shown in FIGS. 3 and 4.

Figure 6:
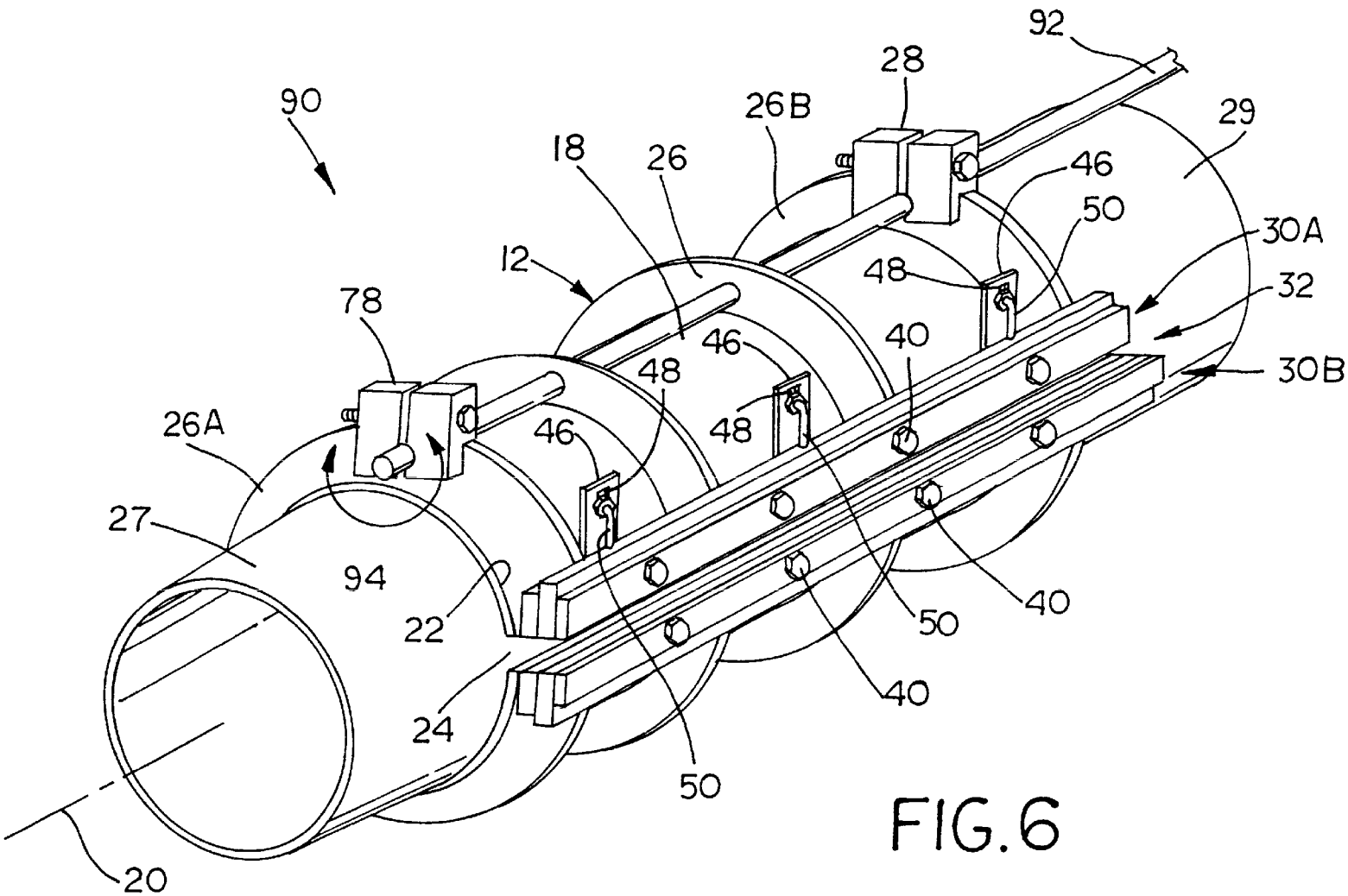
FIG. 6 is a perspective view of another embodiment of an effluent shower of the present invention.

Referring now to FIG. 6, another embodiment of an effluent shower 90 of the present invention is shown. Shower 90 is similar to the embodiment of shower 12 shown in FIG. 1. However, pipe 18 of shower 90 is not rotatable relative to feed pipe 27 for adjusting the discharge angle of the water which is jetted from shower 90. Rather, pipe 18 is rigidly affixed to feed pipe 27, such as through welding, etc. Clamps 28 carried by opposing end gussets 26A and 26B do not radially contract pipe 18 to clamp around feed pipe 27. Rather, clamps 28 are carried by opposing end gussets 26A and 26B, and clamp around a stationary rod 92. Thus, shower 90 and feed pipe 27 each rotate about rod 92 as indicated by directional arrow 94, and are clamped onto rod 92 to set the discharge angle of the fiber suspension issuing from discharge gap 32 of shower 90.

In the embodiments shown, top lips 30A and 62A are deflectable toward or away from lips 30B and 62B, while bottom lips 30B and 62B are substantially immovable. However, it will be appreciated that lips 30B and 62B may be constructed similar to lips 30A and 62A so that each of the pair of lips on opposite sides of slot 24 is adjustable toward or away from each other.

Moreover, in the embodiment of shower 60 shown in FIG. 5, lip 62A does not include a contoured outer lip, while lip 62B does include a contoured outer lip 38. However, it will be appreciated that lip 62A may also be configured to connect with a contoured outer lip 38 if desirable for a specific application.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A washer for washing a fiber suspension, said washer comprising:

a porous surface traveling in a g direction and having a width in a direction transverse to said running direction, said porous surface being configured for carrying the fiber suspension thereon;

a shower including a pipe extending parallel to said width of said porous surface, said pipe having a sidewall with a longitudinally extending slot therein, said shower further including a pair of lips connected to said pipes said lips positioned immediately adjacent to and on opposite sides of said slot, thereby defining a slot nozzle with a discharge gap, said lips being movable toward and away from each other to adjust said discharge gap; and a plurality of brackets connected to said pipe and spaced apart along said slot, and further comprising a plurality of fasteners, each said fastener adjustably connected at one end with one of said brackets and at an opposite end thereof being configured for operatively deflecting one of said lips.

2. The washer of claim 1, wherein each said bracket includes an elongate opening extending transverse to said discharge slot, and each said fastener is received in a corresponding said elongate opening.

3. A washer for washing a fiber suspension, said washer comprising:

a porous surface traveling in a running direction and having a width in a direction transverse to said running direction, said porous surface being configured for carrying the fiber suspension thereon; and a shower including a pipe extending parallel to said width of said porous surface, said pipe having a sidewall with a longitudinally extending slot therein, said shower further including a pair of lips connected to said pipe, said lips positioned immediately adjacent to and on opposite sides of said slot, thereby defining a slot nozzle with a discharge gap, said lips being movable toward and away from each other to adjust said discharge gap, each said lip including an inside surface, each said inside surface being one of disposed at a relatively small acute angle and formed to be concave to thereby effectively form a tapered nozzle with said pair of lips.

4. A washer for washing a fiber suspension, said washer comprising:

a porous surface traveling in a running direction and having a width in a direction transverse to said running direction, said porous surface being configured for carrying the fiber suspension thereon;

a shower including a pipe extending parallel to said width of said porous surface, said pipe having a sidewall with a longitudinally extending slot therein, said shower further including a pair of lips connected to said pipe, said lips positioned immediately adjacent to and on opposite sides of said slot, thereby defining a slot nozzle with a discharge gap, said lips being movable toward and away from each other to adjust said discharge gap; and a plurality of annular gussets partially surrounding said pipe, each said gusset being an annular plate partially surrounding and welded to said pipe, two of said plurality of gussets being respectively disposed at opposite ends of said pipe, each of said two gussets including a clamp for radially contracting said pipe at said opposite ends.

5. A washer for washing a fiber suspension, said washer comprising:

a porous surface traveling in a running direction and having a width in a direction transverse to said running direction, said porous surface being configured for carrying the fiber suspension thereon;

a shower including a pipe extending parallel to said width of said porous surface, said pipe having a sidewall with a plurality of aligned discharge openings arranged longitudinally along a length of said sidewall, said shower further including a pair of lips connected to said pipe, said lips positioned immediately adjacent to and on opposite sides of said plurality of discharge openings, thereby defining a slot nozzle with a discharge gap, said lips being movable toward and away from each other to adjust said discharge gap;

a plurality of brackets connected to said pipe and spaced apart along said slot; and a plurality of fasteners, each said fastener adjustably connected at one end with one of said brackets and at an opposite end thereof being configured for operatively deflecting one of said lips.

* * * * *

UNITED STATES PATENT AND TRADEMARK OFFICE

CERTIFICATE OF CORRECTION

PATENT NO. : 6,502,434 B1
DATED : January 7, 2003
INVENTOR(S) : Doelle

It is certified that error appears in the above-identified patent and that said Letters Patent is hereby corrected as shown below:

Column 5,
Line 35, delete "a g direction", and substitute therefore, -- a running direction --.

Signed and Sealed this

Twenty-seventh Day of July, 2004

JON W. DUDAS
*Acting Director of the United States Patent and Trademark Office*